United States Patent [19]

Mall et al.

[11] 3,954,071

[45] May 4, 1976

[54] SEWING MACHINE HAVING TOP AND BOTTOM FEED SYNCHRONIZING MEANS

[75] Inventors: Günther Mall, Kaiserslautern; Erich Willenbacher, Karlsruhe, both of Germany

[73] Assignee: Firma Pfaff Industriemaschinen GmbH, Germany

[22] Filed: Dec. 4, 1974

[21] Appl. No.: 529,539

[30] Foreign Application Priority Data

Dec. 10, 1973 Germany ..... 2361375

[52] U.S. Cl. ..... 112/207; 112/212; 226/111

[51] Int. Cl.[2] ..... D05B 27/06

[58] Field of Search ..... 112/211, 212, 203, 153, 112/207; 126/108, 111, 112, 115

[56] References Cited

UNITED STATES PATENTS

| | | | |
|---|---|---|---|
| 1,060,799 | 5/1913 | Van Horn | 112/211 X |
| 3,782,310 | 1/1974 | Stockel | 112/153 |
| 3,867,889 | 2/1975 | Conner | 112/212 X |

FOREIGN PATENTS OR APPLICATIONS

| | | | |
|---|---|---|---|
| 286,749 | 8/1915 | Germany | 112/212 |
| 971,862 | 10/1964 | United Kingdom | 112/212 |
| 1,175,971 | 8/1964 | Germany | 112/211 |

*Primary Examiner*—George H. Krizmanich
*Attorney, Agent, or Firm*—McGlew and Tuttle

[57] ABSTRACT

A sewing machine for sewing two material layers to each other in aligned positions, comprises a top feeding mechanism engageable with a top layer for feeding it and a bottom feed mechanism engageable with a bottom layer of material for feeding it. The top and bottom feeding mechanisms are connected to a synchronizing device which regulates the relative speed between the two. A sensor or measuring means is engageable with the material being fed and is connected to the synchronizing means in order to vary the relative speed of the top and bottom feeds in accordance with the actual feed of the material layers.

6 Claims, 4 Drawing Figures

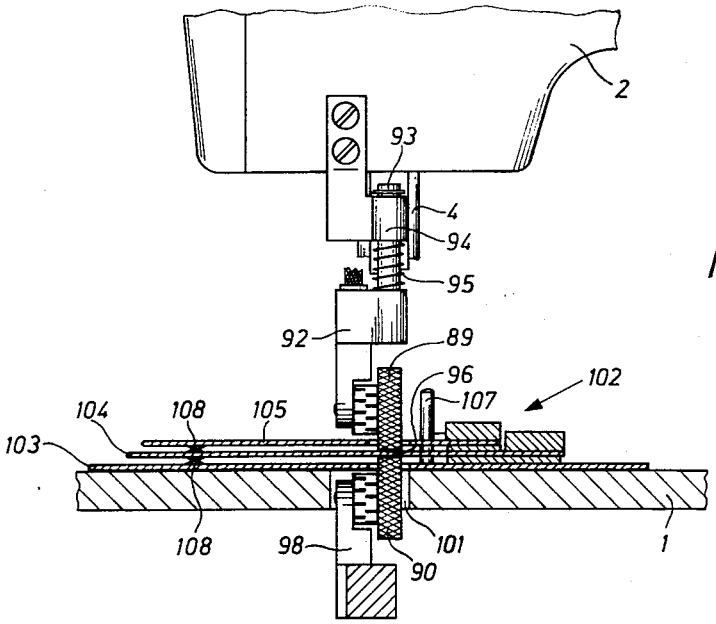
Fig. 2
Fig. 3
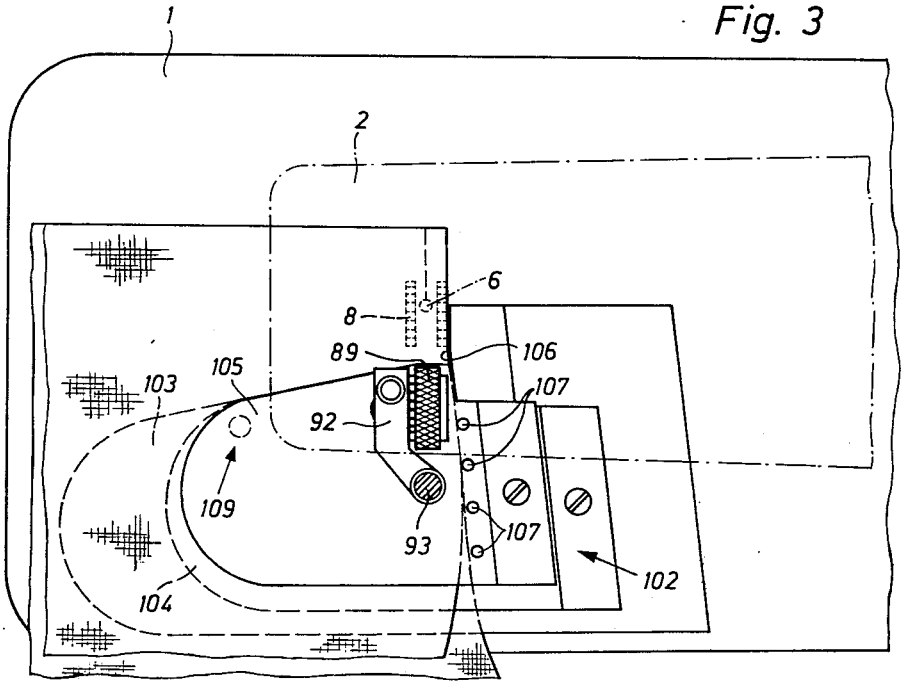

SEWING MACHINE HAVING TOP AND BOTTOM FEED SYNCHRONIZING MEANS

FIELD AND BACKGROUND OF THE INVENTION

This invention relates in general to the construction of sewing machines and, in particular, to a new and useful sewing machine having top and bottom feeds for feeding two materials in aligned positions and to means for regulating the synchronization between the feeds in accordance with the actual feed of the material.

DESCRIPTION OF THE PRIOR ART

For sewing cut parts to each other in aligned positions, such as used in the manufacture of trousers or jackets, it is well-known to equip the sewing machines with a bottom and a top feed device, and to adjust to the same feed rate at both of these feeding devices. Although the advance rate of the bottom and top feeds can be adjusted very accurately, and the working members of the two feeds execute a synchronous motion relative to the advance, time and again, the material layers are mutually displaced if materials are used which are difficult to sew to each other, i.e., one of the material layers advances more or less than the other layer. Even through the feed motion differences of the two material layers per stitch are reduced to some tenths of millimeters at the most, during the sewing of pants or sleeve parts, the differences add to a total amount of one to two centimeters, enough to result in defective and unusable products.

In order to prevent the material layers from displacement, it is known to adjust the feed rates of the feeds differently relative to each other and to counteract the possibility of, or compensate for the discplacement which has already occurred of the material layers in the seam zone by a corresponding manual operation. However, such corrective measures do not lead to a satisfactory result either. This is particularly due to the fact that with different sorts of material and also different thicknesses of the material, the feeding tools advance the two material layers through different distances and thus their effectiveness largely depends on the actual sewing speed. The speed dependency of the feeding tools or of the material frequently results in the irregularity that result at low speeds in layers being connected to each other in aligned positions and at high speeds in misaligned positions. Also, the orientation of the fabric thread relative to the feed direction unfavorably affects the behavior of the material during transportation.

SUMMARY OF THE INVENTION

The invention is directed to a mechanism which insures that two material layers can be sewn to each other without misalignment and substantially independently of the speed of operation and the changes thereof.

For this purpose, in accordance with the invention, each of the material layers is associated with a measuring element sensing the actual feed length before the stitch formation point and acting as an impulse transmitter for an adjusting device synchronizing the feed lengths of the two layers.

Due to the inventive measure of determining the actual feed length of the two material layers by means of a measuring element located before the stitch formation point, and of using the established difference of the feed lengths for an adjusting device controlling at least one of the feeding members, it is possible to counteract the misalignment of the material layers in the seam zone at the very beginning and thereby to considerably increase the quality of the sewing operation.

In order to determine the actual feed length of each of the material layers as exactly as possible and, at the same time, to securely prevent a mutual interference of the two measuring elements, each measuring element comprises a measuring wheel frictionally applied against the associated material layer, and an abutment for the two measuring wheels is provided between the material layers. To prevent the measuring wheels from disturbing the lateral guidance of the two material layers, each measuring wheel is made pivotable about an axis extending in a plane which is perpendicular to the feed plane of the material.

In sewing machines equipped with a guide fixture for an edge-aligned sewing of two material layers to each other, the inventive arrangement makes it possible to carry out the sewing operation completely independent of supervision, both as to the lateral and as to the longitudinal guidance of the material layers. An advantageous design as to the arrangement and association of the measuring device relative to the guide fixture can be obtained by using a guide fixture comprising superposed and spaced supporting plates for the material layers and by insuring that the supporting plate for the upper material layer is also adapted to sustain the two measuring wheels. Thereby, the supporting plate for the upper material layer functions, at the same time, as a means for separating the two material layers from each other and permitting their lateral guidance, and as an abutment for the two measuring wheels.

If a guide fixture is used, in which the supporting plates contact each other at a location in front and laterally of the stitch formation area to form a pressure-contact point for each of the material layers and thereby to prestress the same, care should be taken to arrange the measuring wheels so that they contact the material layers at locations which are outside the tensionally stressed zone of the material layers. This requirement will be securely met by providing that the measuring wheels contact the material layers in front of the stitch formation area at a location which is situated laterally of the connection line between the needle and the pressure contact point.

Accordingly, it is an object of the invention to provide a sewing machine for sewing two material layers, which includes a top feed and a bottom feed for feeding the respective top and bottom layers, and which are connected to means for regulating their speed and which also includes a measuring device for measuring the actual length of the materials being fed and for regulating the speeds of the top and bottom feeds accordingly.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

BRIEF DESCRIPTION OF THE DRAWINGS

In the Drawings:

FIG. 2 is a partial front elevational view of the sewing machine shown in FIG. 1;

FIG. 3 is a top plan view of the stitch formation area of the sewing machine shown in FIG. 1.

DESCRIPTION OF THE PREFERRED EMBODIMENT

Figure 1:
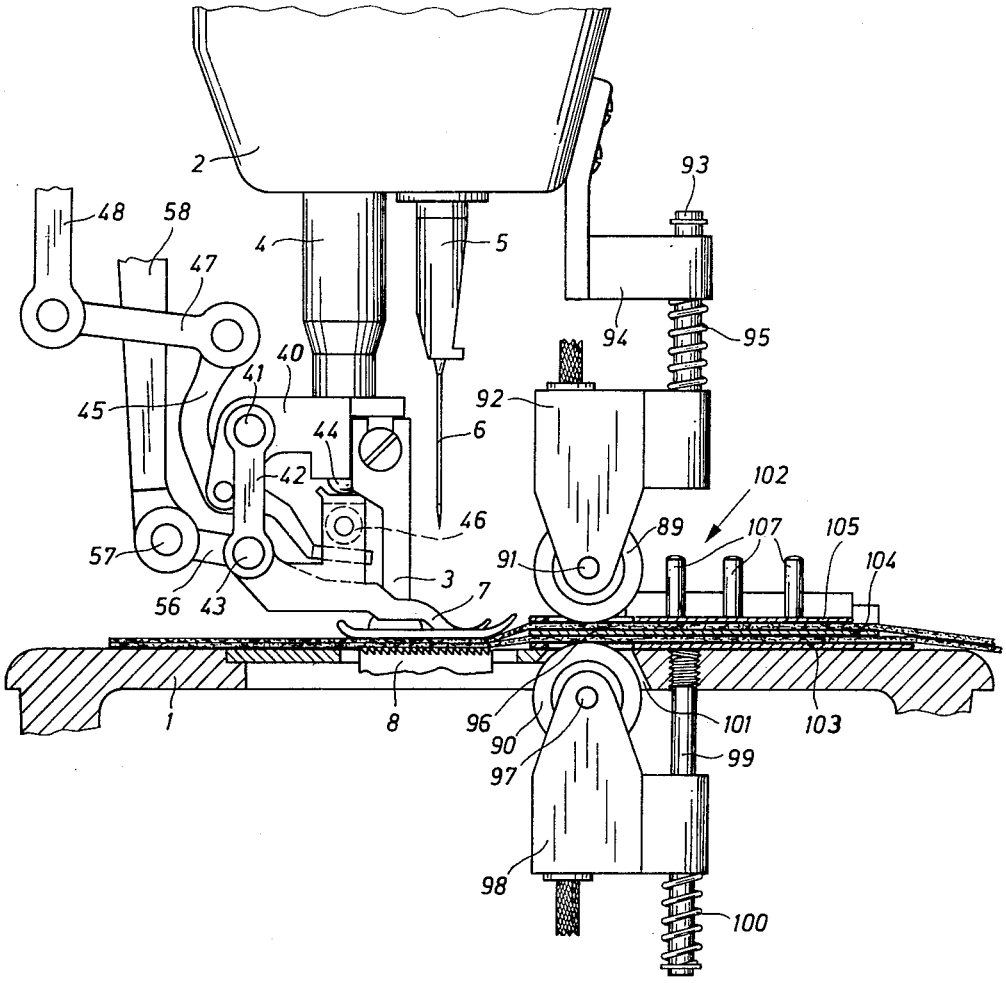
FIG. 1 is a partial side elevational and partial sectional view of a sewing machine constructed in accordance with the invention.

Referring to the drawings in particular, the invention embodied therein, comprises a sewing machine which includes a bed plate 1 over which the material is fed and which is arranged beneath a head portion 2. A presser bar 4 is mounted on the head portion and it carries the usual presser foot 3. A needle bar 5 carrying the thread guiding needle 6 cooperates with a shuttle (not shown) which is located beneath bed plate 1.

In accordance with the invention, the sewing machine shown in FIG. 1, is capable of feeding two material layers using two separate feeding mechanisms which include a top feed dog 7 and a bottom feed dog 8.

Figure 4:
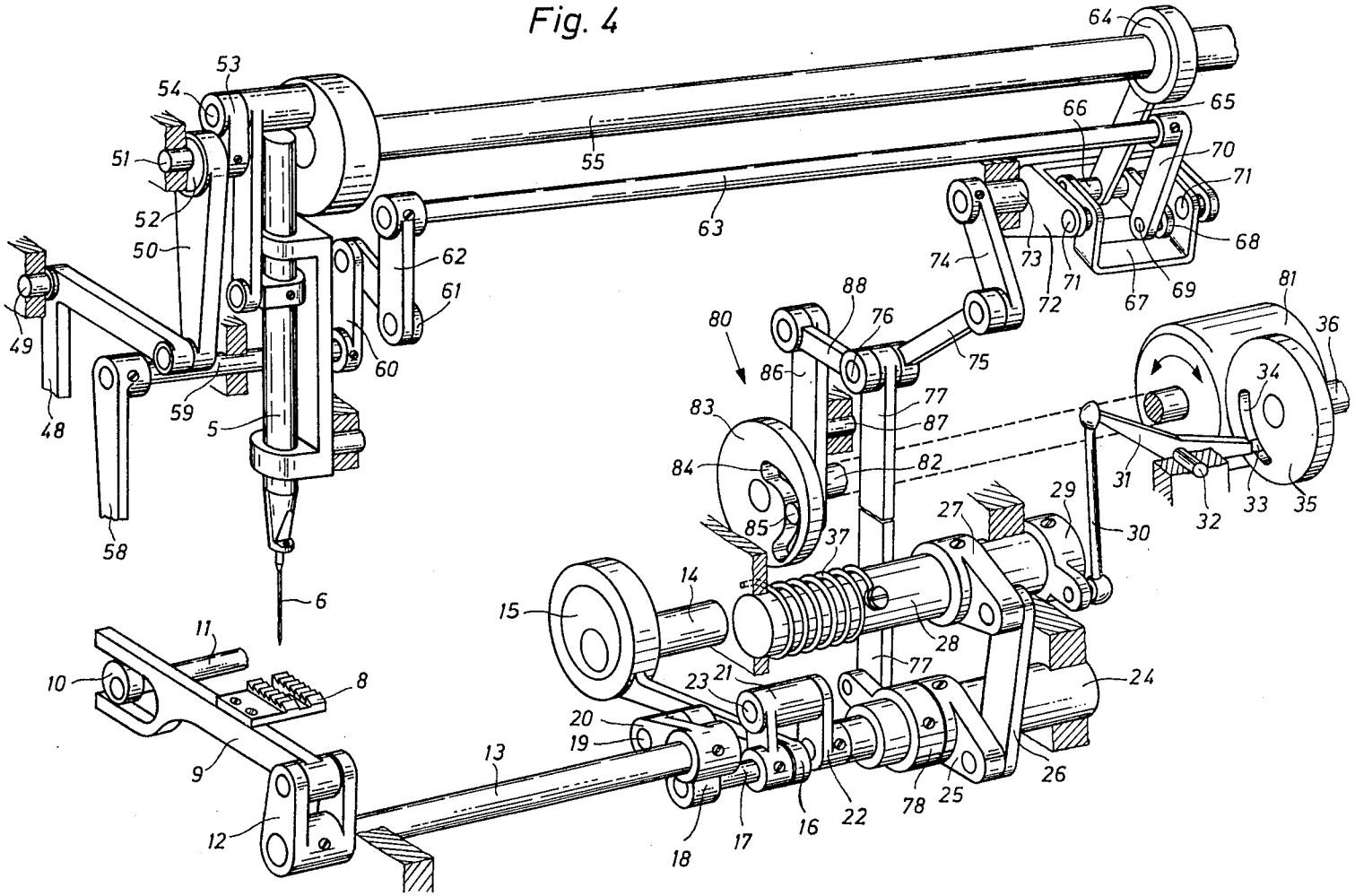
FIG. 4 is a partial perspective view of the mechanical feeding mechanism for the top and bottom feeds.

Bottom feed dog 8, as shown in FIG. 4, is secured to a carrier 9 having a forked end which engages over an eccentric 10 and it is pivoted at its opposite end of a clevis 12. A shaft 11 carries an eccentric 10 which engages within the forked end of the carrier 9 and imparts a stroke motion to the feed dog 8 at each stitch formation. Clevis 12 is secured to a shaft 13 which is also mounted in bed plate 1. Drive shaft 13 is driven by an eccentric 15 which is mounted on a shaft 14 which is parallel to, and in driving connection with, the shaft 11. An arm 16 projects from eccentric 15 and is pivoted to a pin 17. Pin 17 carries a link 18 which is connected through a pin 19 to a crank 20 mounted on shaft 13. A link 21 is located adjacent arm 16 and is secured to pin 17. Link 21 carries a pin 23 which is part of a crank 20. The effective length of link 21 is equal to the effective length of link 18 so that whenever the two pins 19 and 23 are aligned with each other, the shaft 13 remains immobile in spite of a motion of the arm 16. For varying the motion of arm 16 acting on shaft 13, crank 22 is clamped to an adjusting shaft 24 which is mounted in base plate 1 and carries an adjusting crank 25 in addition. Adjusting crank 25 is connected through an intermediate member 26 and another adjusting crank 27 to an intermediate shaft 28 which is mounted in base plate 1 and which carries a lever 29 on its free end. Lever 29 is connected through a ball joint rod 30 to one end of a rocker 31 which is mounted for swinging motion about a pivot 32 which is fixed to the frame. The other end of rocker 31 is formed with a spherical extension 33 and it projects into an adjusting slot 34 which is provided in a lockable adjusting wheel 35. Wheel 35 is mounted on a fixed frame pivot 36. The adjusting slot 34 in wheel 35 extends in a spiral relative to pivot 36 so that stitch lengths of, for example, from 1 to 6 mm can be adjusted at the bottom feed dog 8. A spring 37 which surrounds intermediate shaft 28 and is secured by its one end to bed plate 1 holds the extension 33 of rocker 31 so that it is permanently applied against one of the lateral faces of the adjusting slot 34.

Presser bar 4, as shown in FIG. 1, carries an arm 40 with a pin 41. A link 42 is mounted on pin 41 and it is pivoted by means of a stud 43 to the top feed dog 7. By means of a spring-loaded ball 44, feed dog 7 is permanently pressed downwardly and it receives its stroke motion from a lever 45 which is pivotally mounted on cross arm 40. Lever 45 has a free end which engages from below a roller 46 carried by two lateral extensions of top feed dog 7. The other end of lever 45 is connected through an intermediate member 47 to an angle lever 48 which, as shown in FIG. 4, is pivotally mounted on a fixed pin 49. Angle lever 48 is hinged to an arm 50 of an eccentric 52 which is pivotally mounted on a pin 51 fixed to head 2. Eccentric 52 receives its motion from a link 53 which is pivotally mounted on a pin 54 of a crank formation at the upper main shaft 55 of the machine. Since a relatively small swinging motion of angle lever 48 is sufficient to lift top feed dog 7, the pivotal point between intermediate member 53 and the eccentric 52 is aligned with the upper main shaft 55 of the machine.

In order to drive the top feed dog 7, a link 56 (FIG. 1) which engages on a pin 53, is connected by means of a stud 57 to a rocking lever 58 which in turn is secured to a rocking shaft 59, as shown in FIG. 4, the latter being mounted in head 2 of the sewing machine. Rocking shaft 59 receives its motion from a crank 60 secured thereto which is connected through a link 61 to a crank arm 62 of a rocking shaft 63. The upper rocking shaft 63 is driven off an eccentric 64 which is mounted on the upper main shaft 55. Eccentric 64 includes an arm 65 having an outer end engaged with a pin 66 which is carried by two legs of a bracket 67. A link 68 also engages over pin 66 and is pivoted by means of a pin 69 to a crank 70 which is carried by the upper rocking shaft 63. Bracket 67 is pivotally mounted by means of two aligned studs 71 on an adjusting member 72 which is provided with a stub shaft 73 and which is pivotally mounted in the housing of the sewing machine. By pivoting adjusting member 72 about its stub shaft 73, the relative position between studs 71 and pin 69 and also the magnitude of the swinging motion of crank 70 is changed.

In order to swing adjusting member 72, a link 74 is secured to stub shaft 73 which link acts on the upper end of a connecting arm 77 through a link 75 and a stud 76. The lower end of the connection arm is pivoted to an adjusting crank 78 which is clamped to an adjusting shaft 24. Due to this arrangement, the feed adjustment of the bottom feed dog 8 can be changed in synchronism with the feed adjustment of the top feed dog 7 by adjusting the position of the adjusting wheel 35.

In order to be able to change the feed of the top feed dog 7 relative to the bottom feed dog 8 and in order to obtain mutually equal feed lengths, an adjusting device 80 is provided which comprises a step motor 81 and a control disc 83 mounted on the output shaft 82 of the motor. Control disc 83 is provided with a curved slot 84 into which a pin 85 is engaged. Pin 85 is carried by a rocking lever 86 which is pivotable about a fixed pivot 87 and is pivotally connected at its upper end to a link 88. The other end of link 88 engages through a pin 76 to a connecting arm 77 and to link 75, thereby making it possible to change the angular position of the two links 74 and 75 which form the articulated joint in order to change the feed length of the top feed dog 7 while the adjusting wheel 35 is locked.

Step motor 81 is controlled off two measuring elements 89 and 90 which are located before the stitch forming point and which serve as impulse transmitters of an electrical circuit. Each of the measuring elements 89 and 90 comprise a measuring wheel equipped with two Hall generators associated with a plurality of permanent magnets. Whenever the measuring wheel turns, its Hall generators are penetrated by varying magnetic fields and produce alternating voltages whose frequency is directly proportional to the rotational speed of the measuring wheel. The alternating voltage thus produced is applied to an impulse transmitter (not shown) which is designed so that one impulse corresponds to a definite distance covered by the measuring wheel, for example, to one millimeter. In consequence, the number of impulses delivered by each of the measuring wheels 89 and 90 is a direct measure of the total distance covered by the wheel. This means that with the two measuring wheels 89 and 90 having equal numbers of pulses, the distances covered by wheels 89 and 90 are equal to each other and step motor 81 receives no voltage. If the number of pulses of the upper measuring wheel 89 is preponderant, it has covered a longer distance than the lower measuring wheel. Therefore, motor 81 executes a rotary motion in one direction. If the number of pulses of the lower measuring wheel 90 is preponderant, it has covered a longer distance than the upper measuring wheel and step motor 81 executes a rotory motion in the opposite direction.

The two measuring wheels 89, 90 are positioned so that upper wheel 89 frictionally applies against the upper material layer and lower wheel 90 frictionally applies against the lower material layer. As a result, if the upper material layer runs faster, the number of pulses transmitted by the upper measuring wheel 89 is preponderant and step motor 81 is driven in one direction, and if the lower material layer runs faster, the number of pulses transmitted by the lower measuring wheel 90 is preponderant and step motor 81 is driven in the opposite direction.

As shown particularly in FIG. 1, measuring wheel 89 is rotatably mounted on a horizontally extending pin 91 carried by a support 92. At its upper end, support 92 is provided with a cylindrical extension 93 serving as a pivot and pivotally mounted in a holder 94 which is secured to head 2 of the sewing machine. A spring 95 disposed between holder 94 and support 92 presses the upper measuring wheel 89 against an abutment 96 which is formed by a plate extending parallel to bed plate 1 of the sewing machine and is located between the material layers to be connected to each other. Analogously to the arrangement of the upper measuring wheel 89, the lower measuring wheel 90 is also rotatably mounted on a horizontally extending pin 97 which is carried by a support 98. Support 98 is displaceably and pivotally mounted on a pivot 99 secured to the underside of bed plate 1 and a spring 100 is provided for permanently pressing support 98 upwardly. Lower measuring wheel 90 partly extends through a slot 101 provided in bed plate 1 and applies against the underside of the lower material layer which, in its turn, is thereby applied against abutment 96.

Particular advantages are obtained if the invention is used in connection with a guide fixture for the two material layers. In the embodiment of the invention shown in the drawings, a guide fixture 102 for the two material layers is provided comprising a supporting plate 103, 104 for each of the material layers as well as a cover plate 105 covering the upper material layer. Plates 103, 104 and 105 are spaced from one another by distances corresponding to the thickness of the material layers and extend laterally from a gib 106 (FIG. 3) which is mounted adjacent the stitch formation area and extends in an acute angle to the stitch formation line. Gib 106 serves as a guide for the two material layers in the zone of the stitch formation point. Lower supporting plate 103 is provided with a row of spaced pins 107 which penetrate both supporting plate 104 and cover plate 105 and form a lateral guide for the two material layers in the zone before the stitch formation point. On their surfaces facing each other, both supporting plates 103 and 104, and cover plate 105 are provided with contact beads 108 which are located before and laterally of the stitch formation point and apply against each other to form a pressure-contact point 109 for each of the material layers and thereby to prestress the layers. Due to this location of the pressure-contact point 109 during the feed, the two material layers are tensionally stressed between the stitch formation point and the contact-pressure point 109. However, the area of the material layers laterally of this connection line remains free from any tension so that the measuring wheels 89 and 90, which are positioned before the stitch formation point just laterally of this connection line and project through corresponding slots provided in the lower supporting plate 103 and the cover plate 105, respectively, apply against the material layers in the tension-free area.

The operation of the sewing machine is as follows:

Let it be assumed that the two material layers to be connected to each other are on the associated supporting plates 103 and 104 of guide fixture 102 and, therefore, are positioned between the two measuring wheels 89 and 90 in accordance with FIG. 1. This means that upper measuring wheel 89 is in frictional contact with the upper material layer which rests against abutment 96 and thus against the upper surface of supporting plate 104. The lower measuring wheel is pressed against the lower material layer which also rests against abutment 96 and thus against the underside of supporting plate 104 of guide fixture 102. Suppose that a certain stitch length is adjusted on adjusting wheel 35 which, after adjustment, is locked in a manner known per se. The motion derived from eccentric 15 is transmitted, through the drive connection: arm 16, pin 17, link 18, pin 19, crank 20, shaft 13, clevis 12 to bottom feed dog 8 which therefore executes its feed motion. The motion derived from eccentric 64 is transmitted, through the drive connection: arm 65, pin 66, link 68, pin 69, crank 70, rocking shaft 63, crank arm 62, link 61, crank 60, rocking shaft 49, rocking lever 58, stud 57, link 56 and stud 43, to top feed dog 7 which, therefore, executes a feed motion synchronous with the motion of bottom feed dog 8 as to magnitude and direction. The two material layers are fed to the stitch formation point of the sewing machine and, during this advance motion, are braked independently of each other at the contact-pressure point 109 of guide fixture 102. Due to this braking, the two material layers, independently of each other, execute a rotary motion about pressure-contact point 109 acting as an instantaneous pivot point and come to apply against pins 107 and gib 106. Consequently, the material layers are guided to the stitch formation point with aligned edges.

During the feed of the two material layers, a frictional drive connection is established between upper measuring wheel 89 and the upper material layer and between lower measuring wheel 90 and the lower material layer. Upper measuring wheel 89 executes a rotary motion corresponding to the actual feed length of the upper material layer while lower measuring wheel 90 executes a rotary motion corresponding to the actual feed length of the lower material layer and supporting plate 104, serving at the same time as the abutment 96, ensures noninterference of the two measuring wheels 89 and 90 with each other as well as with the lateral guide of the material layers which might occur due to the pivotal mounting on the cylindrical extension 93 or the pivot 99.

Because of the rotary motion of the two measuring wheels 89 and 90, designed as pole wheels, the Hall generators of each of the measuring wheels produce an alternating voltage which is proportional to the rotational speed of the respective measuring wheel.

As long as the actual feed lengths for the two material layers are equal to each other, the numbers of impulses produced by the two measuring wheels and, therefore, the alternating voltages as well, as identical. Accordingly, no voltage appears at step motor 81. As soon as the actual feed lengths of the two material layers become different, the rotational speeds of the two measuring wheels are no longer equal to each other. This means that the alternating voltages thereby produced are different.

In the example of the invention shown, if the actual feed lengths differ from each other, only the adjustment of top feed dog 7, relative to bottom feed dog 8, is changed by means of the adjusting device 80 in order to obtain mutually equal actual feed lengths of the two material layers. It would also be possible, of course, instead of changing the adjustment of top feed dog 7, to correspondingly change the adjustment of bottom feed dog 8, or even of both feed dogs 7 and 8. As soon as, in spite of the synchronous operation of the two feed dogs 7 and 8, one of the material layers runs faster, for example, the upper layer leads relative to the lower one, step motor 81 receives voltage and imparts a step-by-step rotary motion to shaft 82 and, thereby, to the control disc 83. Rocking lever 86 swivels about its fixed axis 87 and, through link 88, changes the relative position of the two links 74, 75. At the same time, connection arm 77 swings about the pin connecting it to adjusting crank 78. However, this swinging motion has no effect on the adjustment of bottom feed dog 8 because of the locked adjusting wheel 35 and, thereby, blocked crank 78. Due to the change of the mutual position of the two links 74, 75, adjusting member 72 executes a swinging motion about its stub shaft 73, whereby, studs 71, supporting the bracket 67, are approached to the axis of pin 69 and the stroke of eccentric 64 operatively acting on the upper rocking shaft 63 is correspondingly reduced. Voltage remains applied to step motor 81 until the actual feed length of the lower material layer becomes equal to the actual feed length of the upper material layer. Should the actual feed lengths change during the sewing operation so that the lower material layer runs faster than the upper one, step motor 81 receives an opposite voltage and imparts a motion to control disc 83 in the opposite direction.

In such a case, rocking lever 86 executes a swinging motion which is of opposite direction to the first one, the mutual position of the two links 74 and 75 is changed inversely and studs 71 supporting the bracket 67 are moved away from the axis of pin 69. The stroke of eccentric 64 operatively acting on the upper rocking shaft 63 is thereby increased. This adjustment of top feed dog 7 is maintained until the actual feed lengths of the upper and the lower material layers become equal again.

It is evident from the foregoing that the feed distances covered by the individual material layers are instantly equalized whenever a difference appears between the feed lengths. Thereby, provided equal lengths of the material and common beginning of the seam, it is ensured that the two material layers will be connected to each other in aligned position and that any layer displacement during the sewing operation will be instantly corrected. It is, of course, possible to design the control circuitry of step motor 81 so that after each sewing operation, for example, upon stopping of the upper main shaft 55 of the machine in a definite position, output shaft 82 of the motor is returned to its neutral initial position. It is also evident that the inventive device, particularly if used with a guide fixture which appropriately positions the material layers by a breaking action, offers exceptional advantages because in this case, at an unequal braking of the individual material layers, the feed of the associated feed dog is correspondingly changed, i.e., adapted to this braking effect.

While a specific embodiment of the invention has been shown and described in detail to illustrate the application of the principles of the invention, it will be understood that the invention may be embodied otherwise without departing from such principles.

What is claimed is:

1. A sewing machine for sewing two material layers to each other in aligned positions, comprising top feed means for feeding a top layer of material, bottom feed means for feeding a bottom layer of material, synchronizing means connected between said top feed means and said bottom feed means for regulating the speed of said top feed means in respect to said bottom feed means, and continuously operable measuring means engageable with the material being fed adjacent the portion being sewed together and continuously producing measuring pulses and being connected to said synchronizing means to deliver the measuring pulses to said synchronizing means to cause it to vary the relative speed of said top and bottom feed means in accordance with the feed of said material layers.

2. A sewing machine for sewing two material layers to each other in aligned positions, comprising top feed means for feeding a top layer of material, bottom feed means for feeding a bottom layer of material, synchronizing means connected between said top feed means and said bottom feed means for regulating the speed of said top feed means in respect to said bottom feed means, and measuring means engageable with the material being fed and connected to said synchronizing means to vary the relative speed of said top and bottom feed means in accordance with the feed of said material layers; said measuring means comprising a top and bottom rotatable roller engageable with the individual top and bottom layers of material being fed, said rollers comprising impulse transmitters, said synchronizing means comprising an adjusting device connected to said impulse transmitters and responsive thereto for regulating the speed of said top feed means in respect to said bottom feed means.

3. A sewing machine according to claim 2, including an abutment plate disposed between said top and bottom layers, said measuring means comprising a measuring wheel engaged with an associated layer.

4. A sewing machine, according to claim 3, wherein there is a measuring wheel for each layer, each being pivotable about an axis extending in a plane which is perpendicular to the plane of the feed of the material.

5. A sewing machine for sewing two material layers to each other in aligned positions, comprising top feed means for feeding a top layer of material, bottom feed means for feeding a bottom layer of material, synchronizing means connected between said top feed means and said bottom feed means for regulating the speed of said top feed means in respect to said bottom feed means, and measuring means engageable with the material being fed and connected to said synchronizing means to vary the relative speed of said top and bottom feed means in accordance with the feed of said material layers; a guide fixture for an edge parallel sewing of the two material layers to each other, said guide fixture comprising supporting plates for the material layers which are superposed in spaced relationship, the supporting plate for the upper material layer comprising an abutment, said measuring means comprising a separate top and bottom measuring roller engageable with the responsive materials being fed, said top one of said supporting plates comprising an abutment of the two measuring wheels.

6. A sewing machine according to claim 5, wherein said measuring plates contact each other at a location in advance of and laterally to the stitch formation point to form a pressure-contact point and thereby to prestress the material layers, said measuring means comprising a measuring wheel applying against each material layer at a location in advance of the stitch formation point, said sewing machine including a reciprocating needle, said measuring wheels being applied against the material at a location laterally of the connection line between the needle and the pressure-contact point.

* * * * *